US005083513A

United States Patent [19]

Kobayashi

[11] Patent Number: 5,083,513

[45] Date of Patent: Jan. 28, 1992

[54] RAILWAY CAR BOGIE WITH AXLE BEARINGS CENTERED ON BOGIE AXLE

[75] Inventor: Noboru Kobayashi, Kobe, Japan

[73] Assignee: Kawasaki Jukogyo Kabushiki Kaisha, Kobe, Japan

[21] Appl. No.: 638,677

[22] Filed: Jan. 8, 1991

Related U.S. Application Data

[63] Continuation-in-part of Ser. No. 477,582, Feb. 9, 1990, abandoned.

[30] Foreign Application Priority Data

Feb. 10, 1989 [JP] Japan ..... 1-31712

[51] Int. Cl.[5] ..... B61F 5/38; B61F 5/30

[52] U.S. Cl. ..... 105/168; 105/222; 105/224.05

[58] Field of Search ..... 105/165, 167, 168, 218.1, 105/218.2, 222, 223, 224.05

[56] References Cited

U.S. PATENT DOCUMENTS 383,164 4/1888 Youmans ..... 105/165
496,144 4/1893 Williams ..... 105/224.05
2,936,720 5/1960 Van Alstine ..... 105/168 X
4,706,571 11/1987 List ..... 105/168

FOREIGN PATENT DOCUMENTS 128958 8/1983 Japan .
2012912 8/1979 United Kingdom .
2111006 6/1983 United Kingdom .

*Primary Examiner*—Robert J. Oberleitner
*Assistant Examiner*—S. Joseph Morano
*Attorney, Agent, or Firm*—Marshall, O'Toole, Gerstein, Murray & Bicknell

[57] ABSTRACT

A railway car bogie has a bearing (11,12) at the center of each of the front and rear axles (2) and a pair of struts (13, 14) arranged in a V connected at one end to each bearing to define an imaginary center of rotation at or adjacent the center of the bearing and at the other end to the bogie frame (5). By mounting the axle boxes (4) for lateral and longitudinal sliding movement relative to the axle springs (9, 10) around the imaginary center of rotation, a railway car (25) mounted on the bogie exhibits greater stability for high speed straight running and easier passage around tight curves.

9 Claims, 7 Drawing Sheets

RAILWAY CAR BOGIE WITH AXLE BEARINGS CENTERED ON BOGIE AXLE

RELATED APPLICATION

This is a continuation-in-part of application Ser. No. 07/477,582 filed Feb. 9, 1990, now abandoned.

FIELD AND BACKGROUND OF THE INVENTION

This invention relates to a railway car bogie and more specifically to an axle box support device on a railway car bogie. Such a device permits the railway car easier passage on tightly curving tracks and good stability for highspeed running on straight tracks.

Although there is a clear need for railway carriages which are capable of increased running speeds and smooth turning on curved tracks and sufficient running stability on straight tracks, running on curved tracks and running stability are mutually exclusive properties, and it is difficult to achieve both objectives. FIG. 7 of the accompanying drawings illustrates schematically a bogie spring system, and FIG. 8 is one example of a dynamics model based on FIG. 7 for a simulation used to evaluate running stability. As can be seen in FIG. 8, there are two factors related to the support rigidity of axles 32 with respect to running stability; rotational rigidity $K_\phi$ around the vertical axes of the axles 32 and lateral rigidity $K_1$. By optimizing the coefficients of these two factors, running stability can be ensured. It should be noted that 31 indicates the wheels, 33 the bogie frame, and B the railway car body. Focusing on this point, there have been many proposals intended to achieve the dual objectives of running stability and passage on curved tracks. One example is the railway car bogie described in Japanese Provisional Patent Publication No. 58-128958, a plan view of which is shown in FIG. 9 and a detailed view of the axle box support device of which is shown in FIG. 10. The objective of that proposal is to couple bearing boxes 35 having swingable bearings 34 provided at the center of the axles 32 to the bogie frame 33 via a link mechanism comprised of struts 36, 37 and 38 in order to transmit the longitudinal and lateral forces acting upon the axles 32 to the bogie frame 33 via the link mechanism, thus making it possible to reduce the support rigidity of the axle box support device in the longitudinal and lateral directions, which would ensure both running stability and passage on curved tracks. In FIG. 10, 39 indicates another bearing, 40 the axle boxes, 41 the axle springs, 42 the cushioning rubbers and 43 the axle spring seats.

In addition, Japanese Provisional Patent Publication No. 59-106361 is one example of a proposal for suppressing the increase of the moment around the vertical axes of the axles during passage on curved tracks, and the construction is shown in FIGS. 11 and 12. In both drawings the objective is to sufficiently relax the lateral rigidity of the axle springs 44. In FIG. 11, either rubber vibration insulators 46 attached at the mounting location of displacement-proportion type oil dampers 45 or an appropriate rigidity of the mounting location are used to provide elasticity in the longitudinal direction for the axle box support devices. In FIG. 12, a resistance device is comprised by sandwiching the friction plates 48 of friction dampers 47 between rubber vibration insulators 49, and the elastic force in the shear direction of those rubber vibration insulators 49 is used as the stabilizing force in the longitudinal direction for the axle box support devices. When the set resistance force of the resistance device is exceeded, the oil dampers 45 or the friction dampers 47 are displaced, thus suppressing the resistance force with respect to the displacement of the vertical rotation of the axles. 50 indicates the wheels, 51 the carriage frame, 52 the axle boxes, and 53 axle box guards provided with openings $\delta$ in front of and behind the axle boxes 52.

From FIGS. 7 and 8, the primary factors affecting running stability are, as mentioned above, the rotational rigidity $K_\phi$ around the vertical axes of the axles and the lateral rigidity $K_1$. The $K_\phi$ value is expressed as $2b^2K_2$ and is determined by the values of $K_2$ and b. If this dynamics model is applied to the embodiment of Japanese Provisional Patent Publication No. 58-128958 mentioned above for evaluation of running stability, because it is not possible to ensure running stability unless $K_2$, which is the lateral rigidity of the axle springs 41 shown in FIG. 10, is set to the appropriate value, regardless of the bearings 34 and link mechanisms 36 through 38 shown in FIG. 9, $K_2$ cannot be set to a very low value. For this reason, when it is necessary to achieve a large angular displacement around the vertical axes of the axles 32, such as when passing over especially tightly curving tracks, the moment around the vertical axes needed to steer the axles 32 increases, and the creep force between the wheels 31 and the rails needed to generate this moment also increases. Thus, either the rate of slippage between the wheel tread surfaces and the rails increases, which would result in faster wear of both surfaces, or steering will not be possible to the necessary angular displacement around the vertical axes, the wheels 31 will have an attack angle with respect to the rails, and the lateral pressure will increase, thus promoting wear of the wheels and the rails and causing a screeching noise. In FIG. 8, $K_\theta(=2c^2K_3)$ indicates the rotational rigidity existing between the railway car body B and the bogie frame 33.

On the other hand, in Japanese Provisional Patent Publication No. 59-106361, while the railway car is running, in addition to forces acting on the wheels in the direction of movement as a result of power running and braking, if a unilateral type of surface brake is used, an even greater amount of force will be applied in the longitudinal direction. For this reason, if this longitudinal force is applied when the longitudinal support rigidity is kept low by the axle springs 44 shown in FIGS. 11 and 12, this longitudinal force cannot be borne by the axle springs 44, and must be borne by the resistance device, thus resulting in displacement of the resistance device. As a result, because the wheels 50 displace in the longitudinal direction in an approximately parallel state until the axle boxes 52 and the axle box guards 53 contact each other, in addition to the desired cushioning effect in the longitudinal direction being lost, when a curve is entered and the axles undergo angular displacement around the vertical axes, because one of the axle boxes 52 becomes virtually incapable of movement, there is a tendency for the angular displacement around the vertical axes of the axles to be adversely affected. Furthermore, if the lateral rigidity of the axle springs 44 is set to a coefficient sufficiently high to cope with the above-mentioned load in the longitudinal direction, when passing over tightly curving tracks, that rigidity will cause the moment around the vertical axes of the axle to increase, and thus result in a problem similar to that of Japanese Provisional Patent Publication No.

58-128958. In addition, for railway cars which have large differences in the load between the loaded and empty states, because it is necessary to set the resistance force of this resistance device taking into consideration the large load, when the car is empty, a larger than necessary resistance moment around the vertical axes of the axle will be generated during running, which is undesirable.

SUMMARY OF THE INVENTION

The present invention seeks to solve the problem associated with the prior art designs described above by providing a railway car bogie provided with bearings at the centers of the front and rear axles, two pairs of struts each arranged in a V-shape and connected at one end to the bearings to define at or adjacent the center of the bearing an imaginary center of rotation and connected at the other end to the bogie frame, and a resistance device located between each axle box and axle spring section of the axle box support, the resistance device permitting both lateral and longitudinal sliding movement between the axle box and the axle spring section, the longitudinal movement being primarily generated by rotation around the imaginary center of rotation.

With the arrangement described above, because each axle is connected to the center of a V-shaped linkage, the center of each bearing provided at the center of the axle may become the imaginary center of rotation. The ends of the struts forming the linkage are connected to the bogie frame so that when a moment around the vertical axis is generated on the axle, rotation is possible using that imaginary center of rotation as the center for rotation around the vertical axis.

In addition, for the axle box support, relative displacement is possible by sliding between the axle boxes and the axle springs via the resistance device in the lateral direction and also in the lateral and longitudinal directions.

With the combination described above, when the railway car passes over curving tracks, the action of the sloping tread surface of the wheels generates moment around the vertical axes of the axles, and, if that value exceeds the set value, sliding occurs between the axle boxes and the axle spring sections of the axle box support devices, and the axles undergo relative displacement around the vertical axes with respect to the bogie frame. In addition, at this time, the resistance force generated by the resistance device is accounted for primarily by sliding resistance, and, because it depends on the frictional coefficient, it remains approximately constant as long as the load being applied to the axle boxes does not change, even if the rotational angle increases. Furthermore, because the resistance device is provided between the axle boxes and the axle spring sections of the axle box support devices so that the load acting upon the axle boxes in the vertical direction is utilized when generating resistance force, the resistance force has the characteristic of being approximately proportional to the load acting upon the axle boxes.

Although both the maximum stable speed during straight running and the capability for passing over curving tracks will both be improved if the imaginary center of rotation and the center of the axle are the same, it is not absolutely necessary for the axle's imaginary center of rotation and the center of the axle to be precisely the same; if the imaginary center of rotation is set toward the center of the bogie, although the maximum stable speed during straight running will drop, it will be possible to increase the capability for passing over curving tracks.

On the other hand, if the imaginary center of rotation is set toward the end of the bogie, although the capability for passing over curving tracks will drop slightly, it will be possible to increase the maximum stable speed during straight running.

In this way, the imaginary center of rotation can be selected as necessary in accordance with the performance properties required of the bogie.

BRIEF DESCRIPTION OF THE DRAWINGS

The present invention will now be described in greater detail, by way of example only, with reference to the accompanying drawings in which.

DETAILED DESCRIPTION OF THE DRAWINGS

Figure 1:
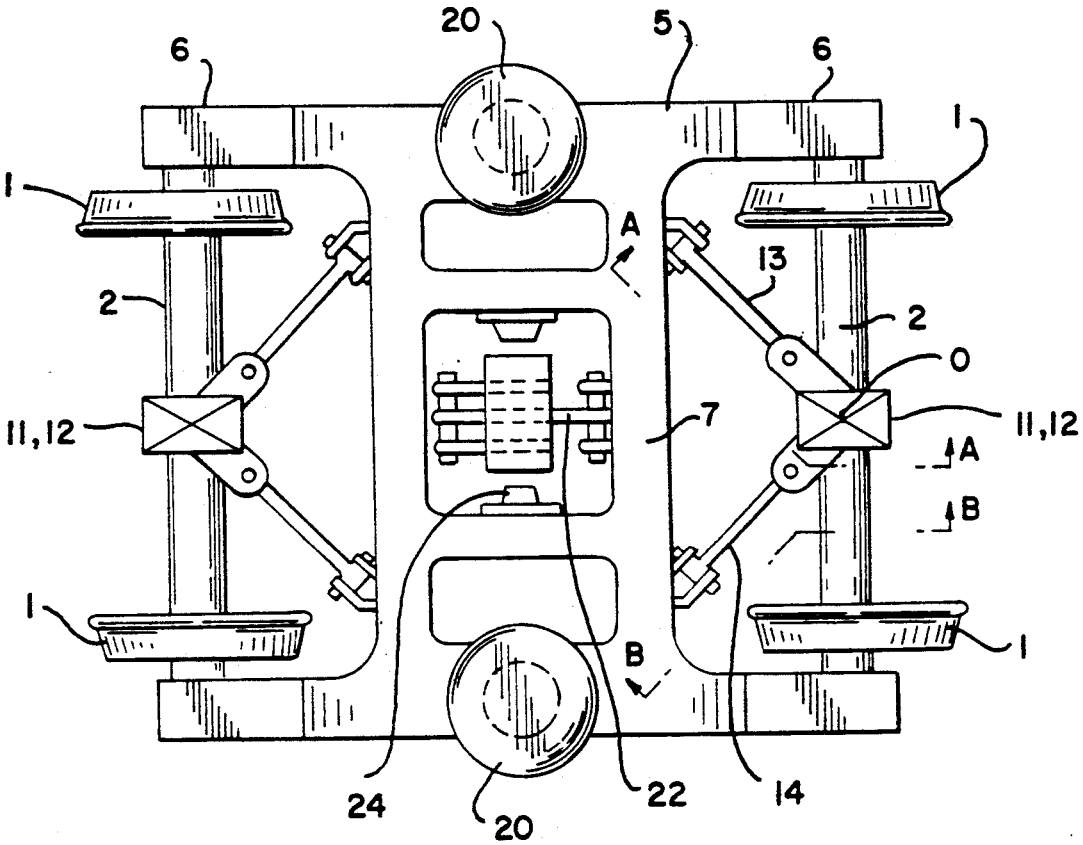
FIG. 1 is a plan view showing one embodiment of a railway car bogie according to the invention.
Figure 2:
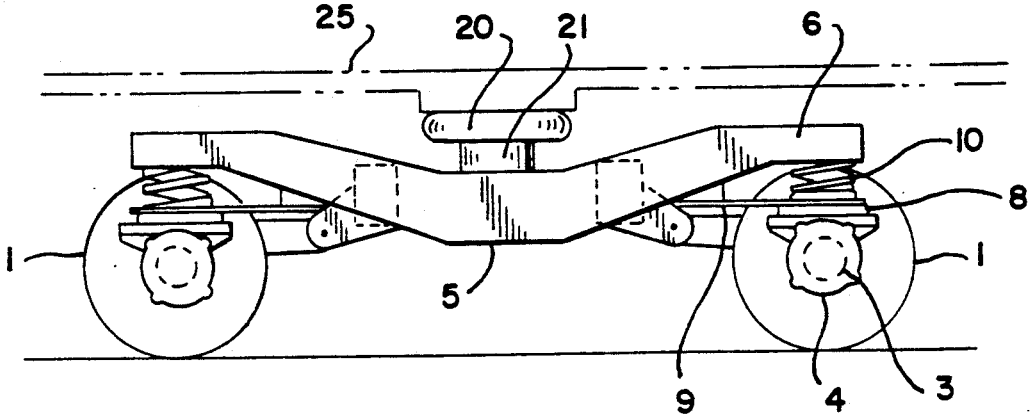
FIG. 2 is a side view of the same bogie shown in FIG. 1.
Figure 13:
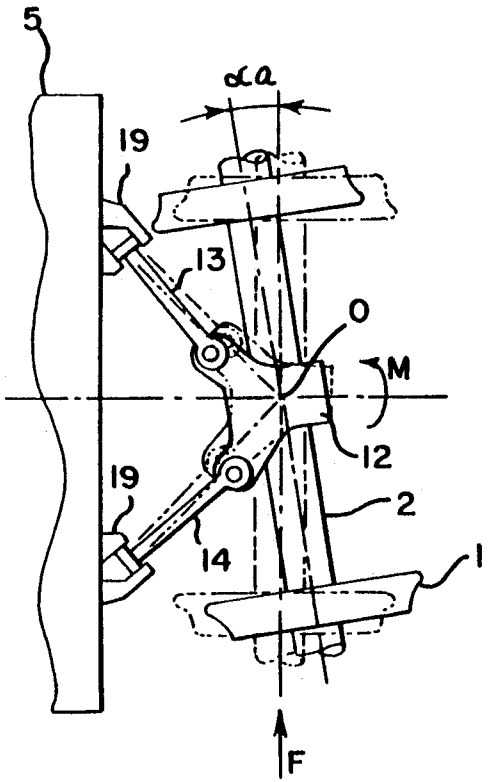
FIG. 13 is a schematic diagram illustrating the embodiment shown in FIG. 1.

Referring to the drawings, FIG. 1 is a plan view showing an embodiment of a railway car bogie according to the invention, which is also shown schematically in FIG. 13. 1 indicates wheels mounted on axles 2, and to the outside of the wheels 1, that is, on the ends of the axles 2 are axle boxes 4 (see FIG. 6) mounted via bearings 3. The axle boxes 4 support side beams 6 via contact strips 8, leaf springs 9, axle spring seats 15, axle springs 10, and axle spring seats 16. The side beams 6 on both sides are connected by lateral beams 7, thus forming the bogie frame 5. In FIG. 2, it can be seen that pneumatic spring seats 21 are formed as part of the bogie frame 5, and the railway car body 25 is supported via pneumatic springs 20. 22 is a thrust transmission device located between the bogie frame 5 and the railway car body 25.

Figure 3:
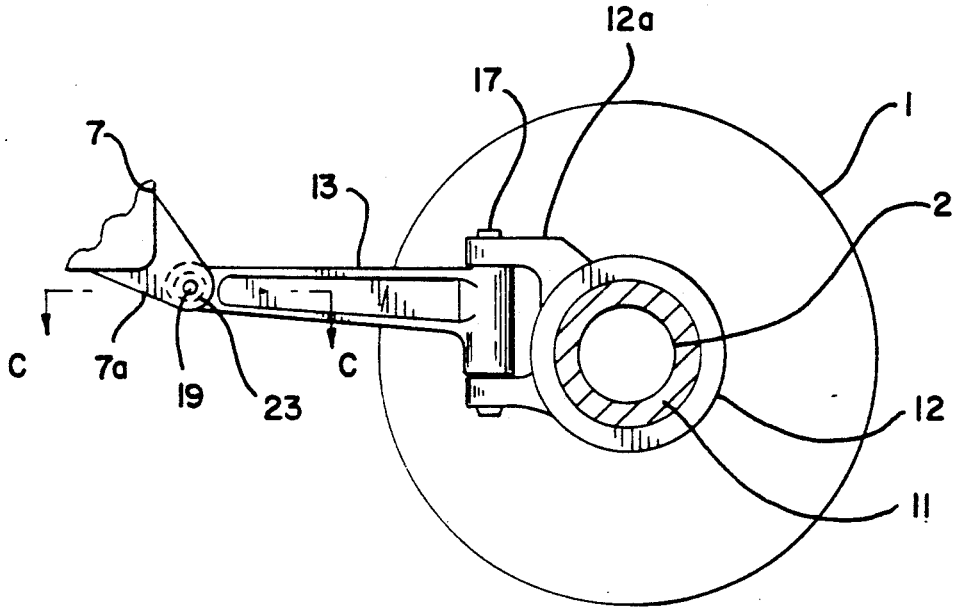
FIG. 3 is a section view along line A—A of FIG. 1.
Figure 4:
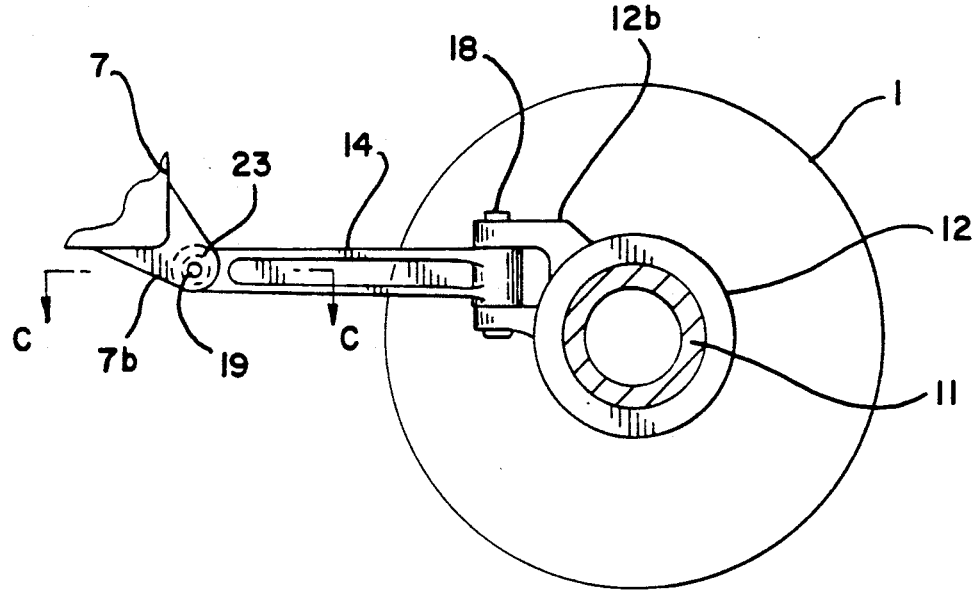
FIG. 4 is a sectional view along line B—B of FIG. 1.

Bearing boxes 12 are provided via rotatable bearings 11 at the centers of the front and rear axles 2. Also, links 13 and 14 which connect these bearing boxes 12 to the lateral beams 7 of the bogie frame are arranged in a V-shape, and the link mechanism is arranged so that lines extended from both of these links intersect at the center points 0 (on the axis) of the axles 2. The construction of each link 13 is such that, as shown in FIG. 3, it is pivotably mounted by upright pin 17 to a pair of upper and lower arms 12*a* extending from approximately the top and bottom of the bearing box 12 provided on the axle 2, and the other end of the link 13 is pivotably mounted by a lateral pin 19 to a pair of right and left arms 7*a* projecting from the lateral beam 7 of the bogie frame. Although the construction of the other links 14 is, as shown in FIG. 4, almost the same as that of the links 13, the construction of the pins 18 which connect the links 14 and the bearing boxes 12 is different, so that, while the links 13 have a restraining function with respect to the rotation of the bearing boxes 12 around the axis of the axle, the links 14 have no such function. In other words, one end of each link 14 is pivotably mounted by upright pin and lower pins 18 to a pair of upper and lower arms 12*b* extending from the upper half of the bearing box 12, and the other end is pivotably mounted by a lateral pin 19 to a pair of right and left arms 7*b* projecting from the lateral beam 7 of the bogie frame. The pins 18 are either pins having an area of play or spherical bearings.

Figure 5:
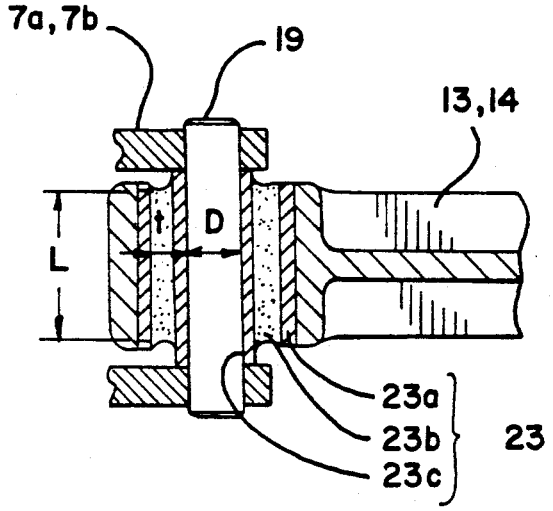
FIG. 5 is a sectional view along lines C—C of FIGS. 3 and 4.
Figure 7:
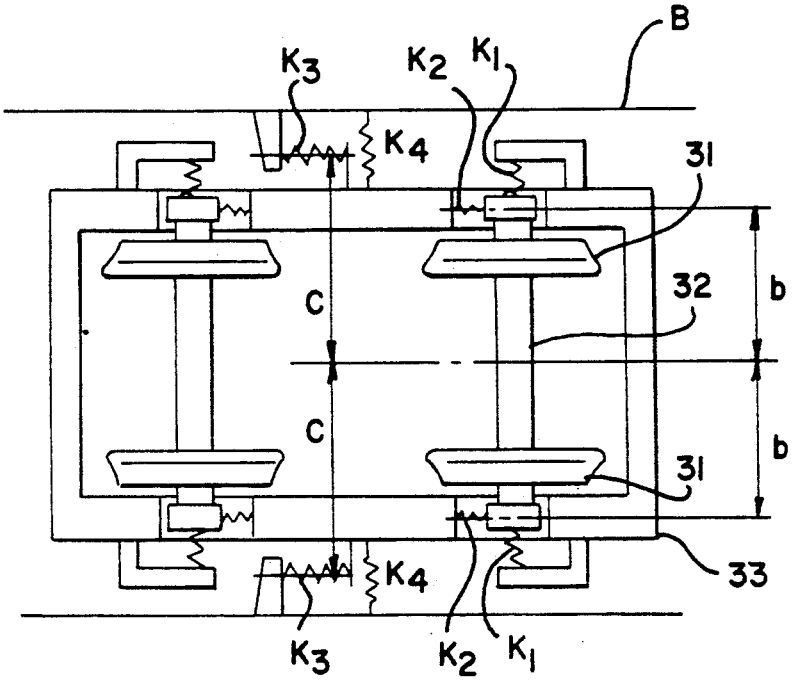
FIGS. 7 and 8 are schematic views of a bogie spring system.
Figure 8:
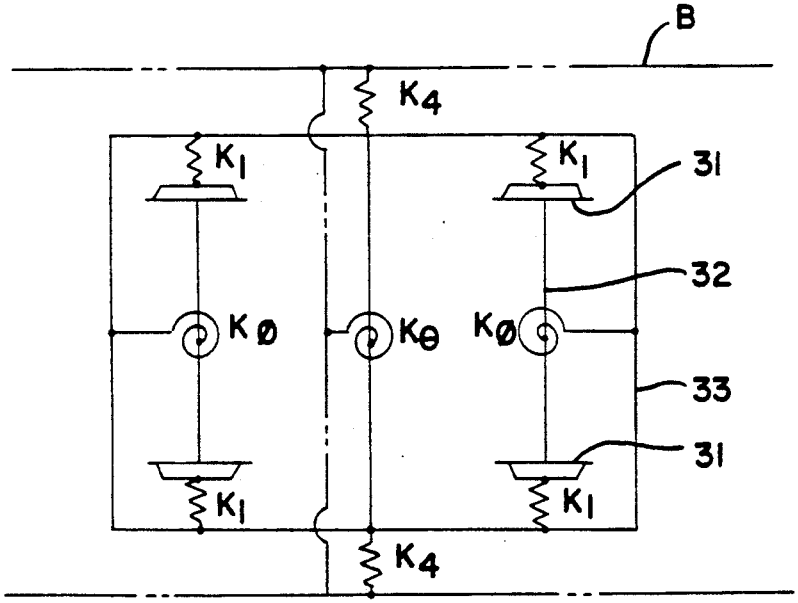
Figure 9:
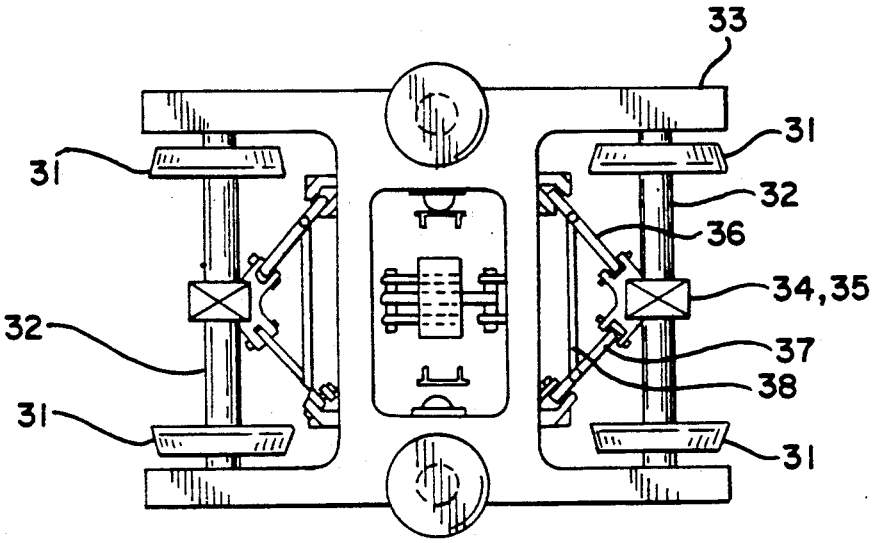
FIG. 9 PRIOR ART
FIGS. 9 to 12 show the composition of the major components of a bogie in accordance with the prior art.
Figure 10:
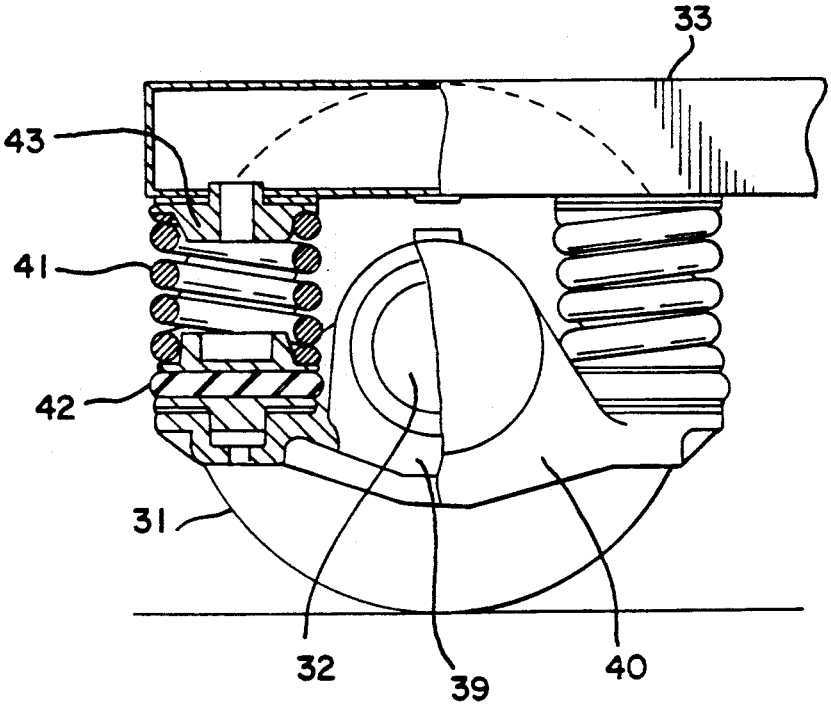
FIG. 10 PRIOR ART
Figure 11:
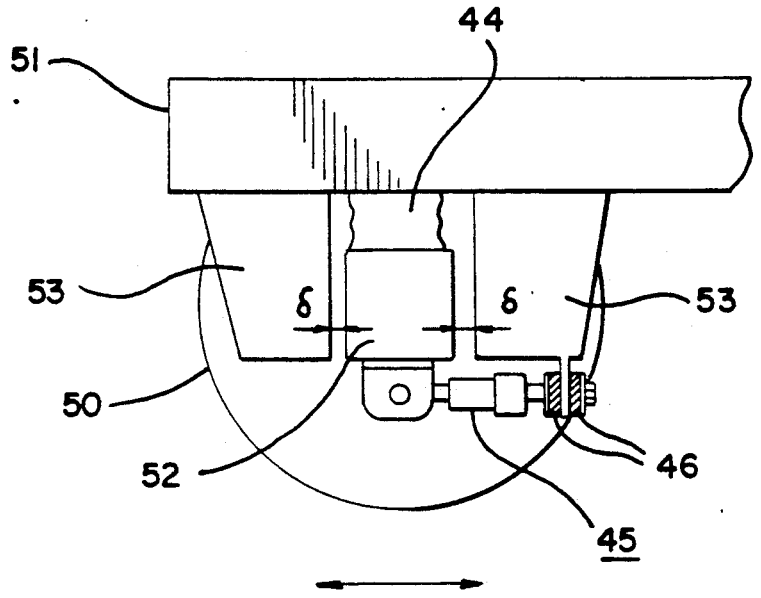
FIG. 11 PRIOR ART
Figure 12:
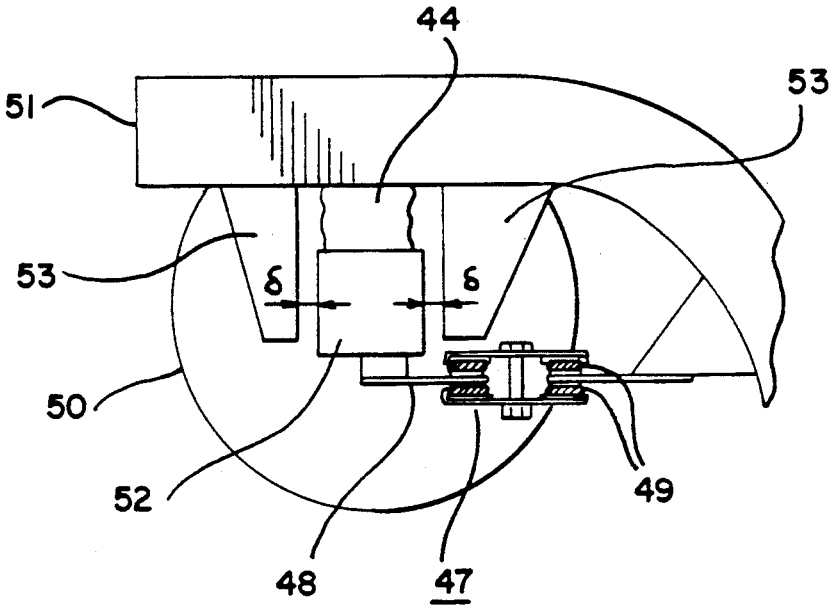
FIG. 12 PRIOR ART

The construction of the pin 19 is shown in FIG. 5. The cushioning material 23 is comprised in an outer tube 23*a*, an inner tube 23*c*, and a cushioning member 23*b*, and it is fabricated in one piece by curing adhesive or similar means. The outer tube 23*a* is a press-fit into the link 13 or 14, and the inner tube 23*c* is pivotably mounted to the arms 7*a* or 7*b* by the pin 19. The characteristics of this cushioning material 23 are that, because there is a twisting action of primarily the cushioning member 23*b*, a soft spring constant is provided for the rotation around the axis of the pin 19. In addition, because of the action of the cushioning member 23*b* in the compressing and expanding directions, a stiff spring constant is provided in the radial (right angle to the axis) direction of the axis of the pin 19. Furthermore, the rigidity in the direction of rotation around an axis at right angles to the plane of the drawing is primarily determined by the dimensions L, D and T and the of elasticity of the material. Thus, if dimension L is lengthened then the rigidity in the direction of rotation will increase. If the imaginary center of rotation of the axle and the center of the axle are not the same, then the rotational rigidity of the cushioning material 23 is set to a high level in order to suppress the amount of lateral movement of the axle. If the imaginary center of rotation of the axle and the center of the axle are the same, because the amount of the lateral movement of the axle is suppressed only by the mutual action of the links 13 and 14, the cushioning material 23 can be considered as the rigidity in the direction of rotation of a mechanism comprised of a system containing two cushioning materials 23 for each axle, rather than the rigidity in the direction of rotation of the single material, and thus the rigidity is set by the radial spring constant, which is the primary factor behind this characteristic.

By providing the pin 19 with a cushioning material 23 having characteristics set in this way, in addition to vertical and rolling displacement of the axles 2 shown in FIG. 1 being permitted, a slight amount of lateral displacement is also permitted.

In this way, through the link mechanism described above, with the axles 2 rotatable around the vertical axes using the intersection areas (point 0) of lines extended from the links 13 and 14 as their imaginary centers of rotation, the longitudinal and lateral forces acting between the bogie frame 5 and the axles 2 are transmitted.

FIG. 13 shows the embodiment wherein lines extended from links 13 and 14 intersect at point 0 coinciding with the center point of axle 2, so that the imaginary center of rotation of the axle is at 0. Because the axle center and rotational center coincide, any lateral force F on wheel 1 produces no moment around the vertical axis at 0 which would rotate the axle . If the self-steering by the tread surface sloping of the wheel causes a moment M around the vertical axis at O, the axle rotates around this axis. Also, any lateral force F on the wheel produces substantially no lateral movement of point O. These characteristics increase the lateral supporting rigidity of the axle, even without rotational rigidity around pins 19 connecting frame 5 to links 13 and 14.

Figure 6:
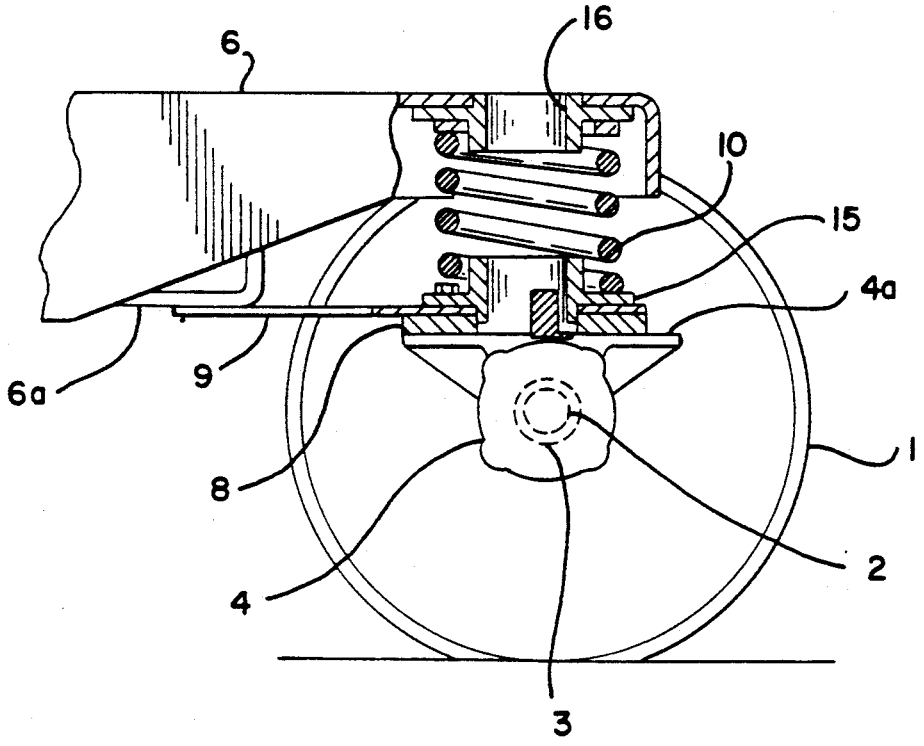
FIG. 6 is a detailed view of the axle support device shown in FIG. 2.

The construction of the axle box support device can be explained with reference to FIG. 6. The axle boxes 4 are revolvably mounted onto both ends of the axles 2 via the bearings 3, and the top surface 4*a* of each axle box 4 is formed in a flat construction capable of sliding. The axle springs 10 are installed between the leaf springs 9 and the side beams 6 via the axle spring seats 15 and 16. One end of each of these leaf springs 9 is secured to the side beam 6 by a bracket 6*a*. Also, contact strips 8 which comprise a resistance device are inserted beneath the leaf springs 9, and these contact strips 8 are positioned as a slidable construction on the top surfaces 4*a* and the axle boxes 4.

Through the construction described above, the movement of the axles 2 in the lateral direction, and in the longitudinal direction primarily generated by rotation around the imaginary center of rotation, results in almost no displacement of the axle springs 10 in either the longitudinal or lateral directions, but simply sliding between the contact strips 8 and the top surfaces 4*a* of the axle boxes 4. The leaf springs 9 hold the underside of the axle spring seats 15, so that the vertical displacement of the axle springs 10 is determined by elasticity of the leaf springs 9.

With the construction described above, because most of the action of the axles 2 in the lateral and longitudinal directions is transmitted to the bogie frame 5 via the link mechanisms without going through the axle box support devices, and because the rotation of the axles 2 with respect to the bogie frame 5 is centered on an imaginary center of rotation comprised by the links 13 and 14, when passing over curving track, the self-steering action provided by the tread surface sloping of the wheels 1 enables the axles 2 to have a rotation angle around the vertical axes of the axles 2 with respect to the bogie frame 5.

In addition, because the resistance force around the vertical axes of the axles 2 consists primarily of the sliding resistance generated between the contact strips 8 of the axle spring support devices which comprise the resistance device and the top surface 4*a* of the axle boxes 4, on straight tracks the resistance force of the contact strips 8 and the top surface 4*a* of the axle boxes 4 which occurs at the axle box support devices is capable of ensuring running stability and also, when passing over tightly curving tracks, the above mentioned self-steering action causes the contact strips 8 and the axle boxes 4 to slide in order to allow for a sufficient compensate for the angle around the vertical axes of the axles. Thus, the attack angle with respect to the rails is reduced, and the lateral pressure of the wheels 1 can be reduced. In addition, it is also possible to reduce the screeching noise of the wheels 1.

Figure 15:
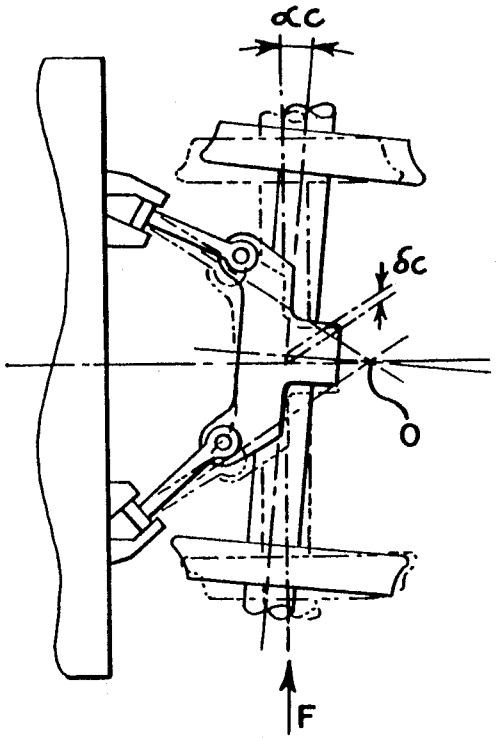
FIG. 15 is a schematic diagram similar to FIGS. 13 and 14 but showing another alternative arrangement.
Figure 14:
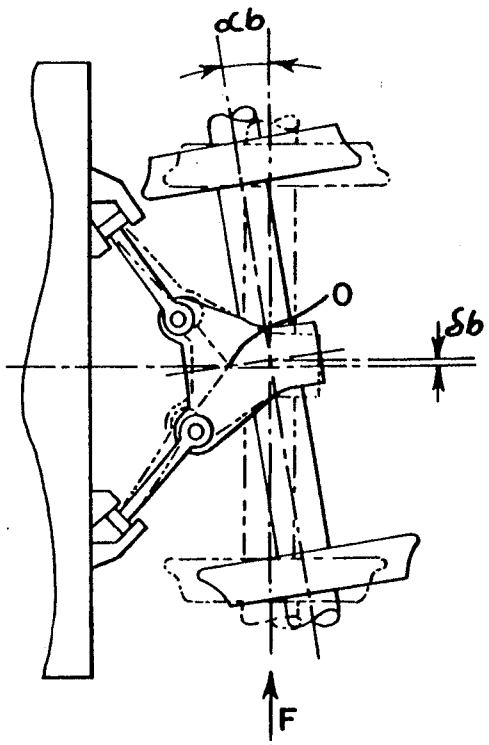
FIG. 14 is a schematic diagram similar to FIG. 13 but showing an alternative arrangement.

FIG. 14 illustrates the embodiment where the imaginary center of rotation O is located toward the center of the bogie from the center of the bearing, and FIG. 15 illustrates the embodiment where the imaginary center of rotation O is located toward the end of the bogie from the center of the bearing.

With reference to FIG. 14, any lateral force F on the wheel produces a moment rotating the axle as pressed in the direction of action of force F around imaginary center O, at which the lines from the links intersect. The axle center point also moves as indicated by $\delta b$ in this direction as the axle pivots through the angle $\alpha b$. In the condition without rotational rigidity around the pins, the lateral supporting rigidity of the axle is low, and it is necessary to provide rotational rigidity for the pins.

With reference to FIG. 15, any lateral force F on the wheel produces a moment rotating the axle through the angle $\alpha c$ as pressed in the direction of action of force F around imaginary center O. The axle center point also moves as indicated by $\delta c$ in this direction. In the condition without rotational rigidity around the pins, the lateral supporting rigidity of the axle is low, and it is necessary to provide rotational rigidity for the pins, as is the case with FIG. 14.

Because the steering performance and traveling stability of a two-axle bogie are greatly affected by characteristics of the front axle, priority is given to the steering performance if the imaginary center of rotation is set adjacent the frame center, and to the traveling stability if it is away from the frame center.

In a construction according to this invention, there is no need to increase or decrease the resistance force in accordance with the fluctuations in the load in order to ensure running stability, and the resistance force generated by the properties of the resistance device is approximately proportional to the load on the bearings. This action makes it possible to minimize the resistance force when the railway car is empty. In this way, it is possible to reduce the amount of wear of the wheels 1 and the rails.

As explained above, the design according to the invention enables curve passage performance to be improved over that of the prior art, thus improving stability for high-speed running on curved tracks, even on small-radius curves. In addition, the lateral pressure on the wheels can be reduced, the screeching noise which accompanies contact between the wheels and the rails can also be reduced, and it is possible to reduce wear of the wheels and rails.

Furthermore, because the resistance force around the vertical axes of the axles increases as the passenger load increases, it is also possible to ensure high-speed stability when running on straight tracks.

What is claimed is:

1. A railway car bogie comprising a bogie frame, front and rear axles, bearings (11, 12) at the centers of said front and rear axles (2), two pairs of struts (13, 14) each arranged in a V and connected at one end to said bearings to define substantially adjacent the center of said bearing an imaginary center of rotation (0) of each of said axles and connected at the other end to said bogie frame (5), an axle box (4) connected to each end of each of said front and rear axles, an axle spring section (15) connecting each axle box with said bogie frame, and a resistance device (8) connected between each axle box (4) and the associated axle spring section (15), said resistance device comprising friction slidable plates permitting both lateral movement and longitudinal sliding movement between each axle box and the associated axle spring section, each of said friction slidable plates being slidable relative to the associated axle box and being immovable relative to the associated spring section, said longitudinal sliding movement being primarily generated by rotation around said imaginary center of rotation, each axle spring section being located substantially directly above the associated axle box, and each of said friction slidable plates being between one of said axle spring sections and the associated axle box.

2. A railway car bogie according to claim 1, characterized in that said center of each bearing (11,12) substantially coincides with said imaginary center of rotation (0).

3. A railway car bogie according to claim 1, characterized in that said center of each bearing (11,12) is located toward the center of the bogie from the imaginary center of rotation (0).

4. A railway car bogie according to claim 1, characterized in that said center of each bearing is located toward the end of the bogie from the imaginary center of rotation (0).

5. A railway car bogie as set forth in claim 1, and further including spring means for applying pressure on said slidable plates.

6. A railway car bogie as set forth in claim 5, wherein each of said axle spring sections comprises an axle spring, and said axle spring also forms said spring means.

7. A railway car bogie as set forth in claim 5, wherein one of said slidable plates is formed by a leaf spring.

8. A railway car bogie as set forth in claim 1, wherein one end of each of said struts has a pivotal connection on a vertical axis and the other end of each of said struts has a pivotal connection on a horizontal axis.

9. A railway car bogie as set forth in claim 8, wherein at least one of said pivotal connections further includes a resilient connecting means.

* * * * *